US006015138A

United States Patent [19]

Kohlberger et al.

[11] Patent Number: 6,015,138

[45] Date of Patent: Jan. 18, 2000

[54] NEWEL POST ANCHORING DEVICE

[76] Inventors: Walter Kohlberger; Ward Kohlberger, both of 866 Main St East, Hamilton, On, Canada, L8M 1L9

[21] Appl. No.: 08/766,176

[22] Filed: Dec. 12, 1996

[51] Int. Cl.[7] ..... E04H 17/14

[52] U.S. Cl. ..... 256/65; 256/70; 403/200; 52/295; 52/296

[58] Field of Search ..... 52/296, 295; 248/530; 403/187, 200, 300, 306, 301, 405.1, 407.1, 258, 260; 256/65, 59, 68, 69, 70; 411/60, 61, 55

[56] References Cited

U.S. PATENT DOCUMENTS

| | | | |
|---|---|---|---|
| 1,805,731 | 5/1931 | Beckwith | 52/296 X |
| 3,108,664 | 10/1963 | Vawter | 52/296 |
| 3,633,862 | 1/1972 | Breen | 256/65 X |
| 4,295,308 | 10/1981 | Korfanta | 52/296 |
| 4,295,638 | 10/1981 | Eldeen | 256/59 |
| 4,650,164 | 3/1987 | Shepherd | 256/65 X |
| 4,854,549 | 8/1989 | Roberts et al. | 256/65 X |
| 5,095,668 | 3/1992 | O'Brien et al. | 256/65 X |
| 5,419,538 | 5/1995 | Nicholas et al. | 256/65 |

*Primary Examiner*—Terry Lee Melius
*Assistant Examiner*—William L. Miller

[57] ABSTRACT

A newel post anchoring device, for connecting a post to a concrete floor, wherein the post has a transverse bottom surface and the concrete floor has a floor surface. The newel post anchoring device includes a base having a top with a periphery, and a bottom load bearing surface, wherein the top of said base abuts the transverse bottom surface of the post, and the bottom load bearing surface abuts with the floor surface, thereby the base transmits the load of the post to the floor and also elevates the post above the floor to minimize deterioration of the post. The anchoring device further includes a threaded stud with a stud bottom end for securely embedding in the floor and a threaded stud top end dimensioned and adapted to engage with a threaded aperture defined in the top such that the base is screwed down over the threaded stud top end for bringing the load bearing surface of the base into surface engagement with the floor surface. The base further includes a plurality of holes defined in the top, disposed proximate the top periphery, the holes adapted to receive fastening screws there through for bringing the newel post transverse bottom surface into surface engagement with the top of the base and rigidly fastening the newel post to the base.

4 Claims, 3 Drawing Sheets

NEWEL POST ANCHORING DEVICE

FIELD OF THE INVENTION

The present invention relates generally to fastening systems for securing posts and the like to a base or floor and more particularly relates to newel post anchoring devices for anchoring a newel post to a hard floor such as concrete.

BACKGROUND OF THE INVENTION

A newel post used in building construction is generally an exterior or interior vertical post mounted at the head or foot of a flight of stairs. A newel post may also be the end or anchor post for a handrail which extends around the periphery of an exterior or interior porch or landing. The newel post serves to support a handrail around the periphery of the stairs, porch, or landing. In view of the important structural and safety considerations for such applications, fastening hardware used to anchor a newel post to a floor must be structurally strong and reliable. Currently in the industry the usual means of attaching or anchoring of a newel post to a floor is by means of metal brackets or plates. These brackets are usually visible and unsightly after joining the newel post to the floor and require extra millwork to be added after installation for concealment. The brackets are designed primarily for interior applications for use with wooden floors and do not take into account the special requirements of exterior installations such as concrete floors, corrosion resistance, and rot resistance.

There are a number of prior art devices which are described for fastening newel posts to floor or floor surfaces. For example, U.S. Pat. No. 4,367,864 by Eldeen dated Jan. 11, 1983, U.S. Pat. No. 4,854,549 by Roberts et. al. dated Aug. 8, 1989 and U.S. Pat. No. 5,419,538 by Nicholas et al. dated May 30, 1995 describe devices which can be used to attach newel posts to floor and floor surfaces.

The Eldeen device describes a newel post assembly which is to be used in conjunction with wood floors and provides a bracket for attaching a newel post to a wooden floor. This bracket is intended to be used in interior applications in conjunction with wooden floors. The bracket base is visible after installation and needs to be concealed to hide the installation hardware. This device is not designed for exterior applications or applications where concrete floors are present.

The newel post fastening system as described by Nicholas et al. is a very complex fastening system which requires extensive boring in both the floor surface and into the base of the newel post. This bracket is also intended to be used in interior applications in conjunction with wooden floors.

The newel post fastener and rail attachment device described by Roberts et al. is a relatively simple newel post attaching system which again is to be used in conjunction with newel posts and wooden floor and floor surfaces. This device does remain concealed once installed under the newel post, however it appears to provide very little structural integrity and strength to bending forces applied to newel posts once installed. This device is not designed for exterior applications or applications where concrete floors are present.

None of the above-mentioned prior art devices attempt to provide a solution for attaching newel posts to floor and floor surfaces which are made of hard material such as concrete. Nor do they address the problem of rotting of wooden bases in exterior applications or corrosion of the installation hardware. Concrete exterior staircases and concrete porches and landings are often used in new home construction and require the placement of newel posts at the base of the staircases and/or around porches or landings. Exterior applications have unique requirements in that the floor surface is usually concrete and the base and newel post is exposed to the elements especially rain and moisture.

Accordingly, there is a need for a newel post anchoring device system which allows the anchoring of newel posts to concrete floors and floor surfaces, which is structurally rigid and safe, provides a rot and corrosion resistant base, is aesthetically pleasant to look at, and easy to install.

SUMMARY OF THE INVENTION

In accordance with one aspect of the present invention the apparatus comprises a newel post anchoring device, for use with a newel post having a transverse bottom surface and anchoring the newel post to a concrete floor. The newel post anchoring device comprises a base having, a top with a periphery, a bottom load bearing surface with the top in surface engagement with the transverse bottom surface of the newel post. The load bearing surface is in surface engagement with the floor such that the base transmits the load of the newel post to the floor and the base elevates the newel post above the floor to minimize deterioration of the newel post. The newel post anchoring device further comprises an anchor means for providing a rigid anchor to the floor, a fastening means for securely fastening the anchor means to the base, and an attaching means for attaching the base to the transverse bottom surface of the newel post. The anchor means, fastening means, and attaching means are not visible when the newel post is anchored to the floor.

Preferably the fastening means comprises an aperture defined in the top, adapted to co-operate with and rigidly fasten to the anchor means.

Preferably the fastening means further comprises a reinforcing means for reinforcing the top. The reinforcing means extending around the proximity of the periphery of the aperture.

Preferably the reinforcing means is a cylindrical lug being integrally part of the top and extending vertically upward or downward from the top and preferably the aperture is a threaded aperture.

Preferably the anchor means comprises a threaded stud with a stud bottom end securely embedded in the floor and a threaded stud top end dimensioned and adapted to engage with the threaded aperture defined in the top. The base is screwed down over the threaded stud top end until the load bearing surface of the base comes into surface engagement with the floor.

Preferably the anchor means comprises a rod with a rod bottom end securely embedded in the floor and a threaded rod top end dimensioned and adapted to engage with the threaded aperture defined in the base. The base is screwed down over the threaded rod top end until the load bearing surface of the base comes into surface engagement with the floor.

Preferably the anchor means comprises a wedge bolt with a wedge bolt bottom end adapted for anchoring the wedge bolt into a pre-drilled hole in the floor, and a threaded wedge bolt top end dimensioned and adapted to engage with the threaded aperture defined in the base. The base is screwed down over the threaded wedge bolt top end until the load bearing surface of the base comes into surface engagement with the floor.

Preferably the base further comprises a flange extending vertically downward from the periphery of the top such that the top of the base is elevated above the floor when the load bearing surface engages the floor.

Preferably the attaching means comprises a plurality of holes defined in the top, disposed proximate the top periphery, the holes adapted to receive fastening screws there through for bringing the newel post transverse bottom surface into surface engagement with the top of the base and rigidly fastening the newel post to the base.

Preferably the top slopes downward such that water will run off the top away from the newel post.

In accordance with another aspect of the present invention a newel post assembly for erecting and anchoring a newel post to a concrete floor, comprises a newel post having a transverse bottom surface and a base having a top with a periphery and a bottom load bearing surface. The top is in surface engagement with the transverse bottom surface of the newel post and the load bearing surface is in surface engagement with the floor such that the base transmits the load of the newel post to the floor and the base elevates the newel post above the floor to minimize deterioration of the newel post. The newel post assembly further comprises an anchor means for providing a rigid anchor to the floor, a fastening means for securely fastening the anchor means to the base, and an attaching means for attaching the base to the transverse bottom surface of the newel post such that the anchor means, fastening means, and attaching means are not visible when the newel post is anchored to the floor.

BRIEF DESCRIPTION OF THE DRAWINGS

The invention will now be described by way of example only, with references to the follow drawings in which.

DETAILED DESCRIPTION OF THE PREFERRED EMBODIMENT

Figure 1:
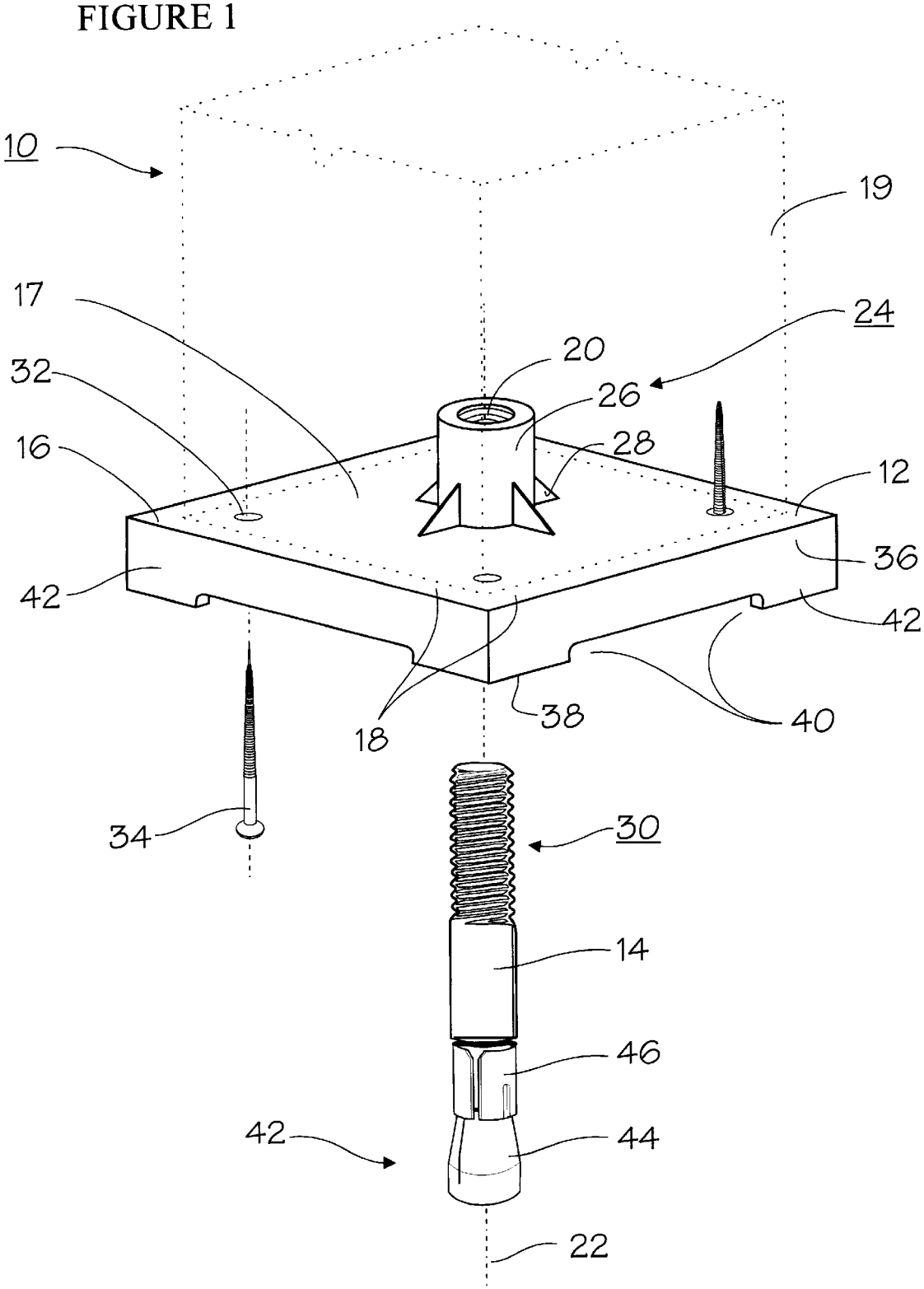
FIG. 1 is a schematic exploded perspective view of the newel post anchoring device, showing a newel post in position in fathom lines.
Figure 2:
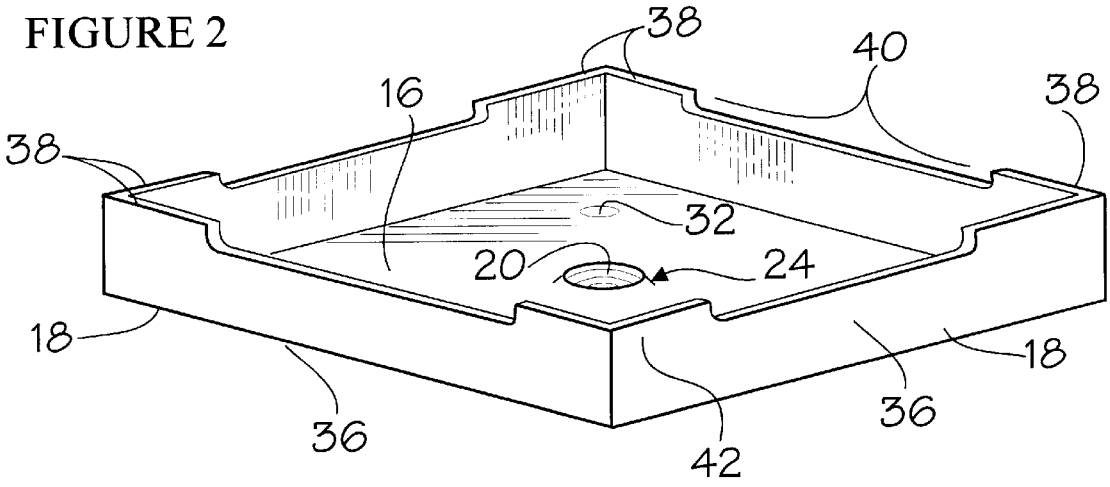
FIG. 2 is a schematic bottom perspective view of the base, shown from the underside.

Referring now to FIG. 1 and 2 a preferred embodiment of the present invention a newel post anchoring device shown generally as 10 comprising a base 12 and a wedge bolt 14. The outline of a newel post 19 is shown in situ mounted on base 12 in fathom lines in order to illustrate how newel post 16 co-operates with newel post anchoring device 10.

Viewed from the top, base 12 is square in shape and has a periphery 18 which parallels the outer cross sectional periphery of newel post 19 but is slightly larger in size to insure that newel post 19 is in complete surface contact with base 12. The base configuration also provides an aesthetically pleasing bottom to the newel post once installed. It will be apparent that the shape of base 12 when viewed from the top can be square, round, hexagonal or any other shape that a newel post may be with the periphery 18 of base 12 parallelling the outer cross sectional periphery of whatever the cross sectional shape of the newel post.

Base 12 comprises a top 16 having a periphery 18 which defines the shape of base 12 when viewed from the top. Top 16 is a thin plate like structure having a re-enforcing means shown generally as 24 preferably comprising a cylindrical lug 26 centred on vertical axis 22 and extending vertically upwards from top 16. Cylindrical lug 26 is rigidly connected and integrally part of base 12, and preferably also has ribs 28 for additional re-enforcement and stiffness. A threaded aperture 20 is defined in cylindrical lug 26 centred on vertical axis 22 and is dimensioned and adapted to threadably engage wedge bolt top end 30 of wedge bolt 14.

Top 16 further comprises a plurality of holes 32 disposed proximate base periphery 18. Holes 32 are adapted to receive there through fastening screws 34 which are screwed into the transverse bottom surface 17 of newel post 19 thereby rigidly attaching newel post 19 to base 12. Base 12 further comprises flanges 36 extending vertically downward from periphery 18 of top 16. Flanges 36 have relief sections 40 centred on each flange 36 of base 12 creating the appearance of legs 42 positioned on the bottom comers of base 12. The bottom surface of legs 42 is load bearing surface 38 which comes into surface engagement with floor surface 50.

Wedge bolt 14 comprises wedge bolt top end 30 and wedge bolt bottom end 42. Wedge bolt 14 is a conventional commercially available wedge bolt. Wedge bolt bottom end 42 has a conical taper 44 and split sleeve 46 mounted thereon. Wedge bolt top end 30 is threaded and dimensioned to threadably engage threaded aperture 20 in base 12. Fastening screws 34 are conventional commercially available, suitable wood screws which are used to screw into the bottom of newel post 19. Fastening screws 34 may also be any other fastening device known in the art which is suited for this purpose.

Figure 3:
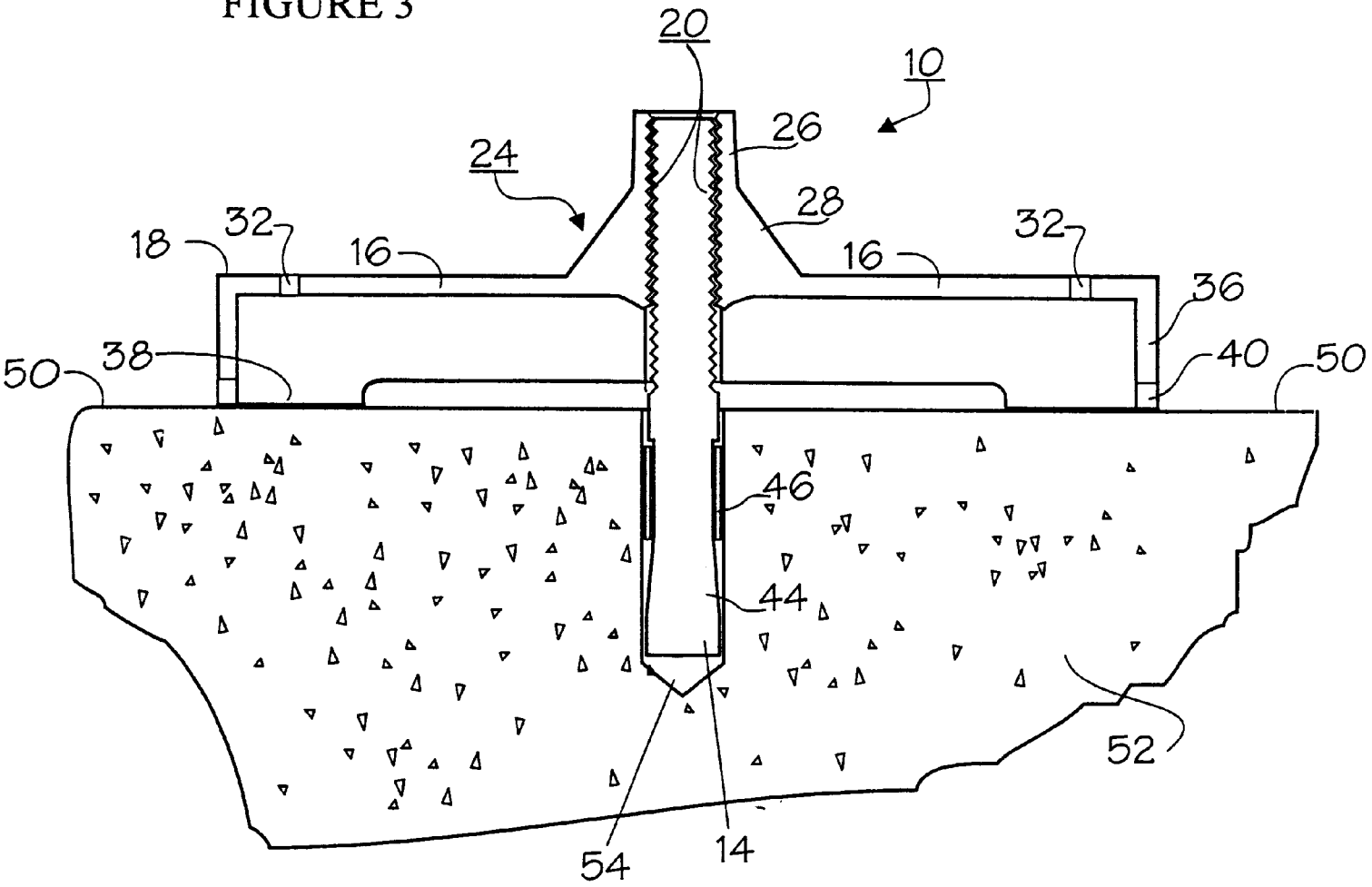
FIG. 3 is a schematic centre cross sectional elevational view of the newel post anchoring device shown deployed in a concrete floor.

Referring now to FIG. 3 the newel post anchoring device shown generally as 10 is shown deployed in a concrete floor 52 having floor surface 50. Installation hole 54 is pre-drilled into concrete floor 52 and wedge bolt 14 is placed therein. Wedge bolt 14 is set in concrete floor 52 by upwardly urging wedge bolt 14 out of installation hole 54 thereby engaging split sleeve 46 with installation hole 54 setting wedge bolt 14 in place. Threaded aperture 20 threadably engages to wedge bolt top end 30 of wedge bolt 14. Base 12 is threadably screwed down over wedge bolt 14 until load bearing surface 38 makes contact and comes into surface engagement with floor surface 50.

In use, the preferred method of installing the newel post anchoring device 10 is as follows. Firstly, a vertical installation hole 54 is drilled into concrete floor 52 and is dimensioned and adapted to receive the wedge bolt bottom end 42 of wedge bolt 14. A washer, not shown, is placed over wedge bolt 14 and comes to rest on floor surface 50. Next, a nut having internal threads dimensioned and adapted to threadably screw onto wedge bolt top end 30 of wedge bolt 14 is screwed down over wedge bolt 14 making contact with the washer thereby urging wedge bolt 14 upwardly out of installation hole 54. This action jams and wedges split sleeve 46 of wedge bolt 14 into installation hole 54 and sets wedge bolt 14 into place. The nut and washer used to set wedge bolt 14 are then removed and discarded. Base 12 is then attached to the transverse bottom surface 17 of newel post 19 using fastening screws 34 passing through holes 32 and screwing fastening screws 34 into the transverse bottom surface 17 of newel post 19. The transverse bottom surface 17 of newel post 19 is suitably relieved to allow for the size and shape of cylindrical lug 26 and ribs 28 and ensure flush surface contact with top 16. Once newel post 19 is securely attached to base 12 the combination of newel post 19 with base 12 attached is then threadably screwed down over wedge bolt top end 30 of wedge bolt 14 until load bearing surface 38 comes into contact with floor surface 50 making surface engagement with floor surface 50.

The newel post is now secured into position with only flanges 36 and a portion proximate the periphery 18 of top 19 visible from beneath the bottom of newel post 19. There are no brackets or other protrusions from the base which require additional millwork for covering up. The visible portions of base 12 appear to be an extension of newel post 19. Newel post 19 and visible portions of base 12 can now be painted for an aesthetically pleasing and attractive newel post installation.

Top 19 and flanges 36 raise the transverse bottom surface 17 of newel post 19 above floor surface 50 in order to minimize rot and deterioration of the bottom of newel post 16. This is of particular concern for newel posts constructed of wood since the end grain, which tends to absorb moisture, is present at the transverse bottom surface 17. Therefore base 12 provides an elevated support for newel post 19 which helps keep the bottom of newel post 19 dry thereby minimizing rotting.

Base 12 is preferably made of cast aluminum for its strength, rot and corrosion resistance properties. It will be apparent however that base 12 can also be made of plastic, fibreglass or other materials depending on the application and properties desired. The thickness of top 16 and flanges 36 can be varied in order to accommodate the choice of material used to manufacture base 12, and to accommodate the load bearing requirements of base 12. Cylindrical lug 26 is shown extending vertically upward from top 16.

The Figures disclose a wedge bolt 14 which is used to anchor the base 12 to the floor. It is also possible to use a threaded stud or a rod which is embedded in a concrete floor to fasten base 12 to a floor. A threaded stud or rod may be preferable in applications were the concrete is not already in place but can be poured prior to the installation of the Newel Post.

It should be apparent to persons skilled in the arts that various modifications and adaptation of the structure described above are possible without departure from the spirit of the invention, the scope of which defined in the appended claims.

I claim:

1. In combination, a newel post assembly including a newel post and a concrete floor, the newel post assembly for erecting and anchoring the newel post to the concrete floor, comprising:

a) the newel post having a transverse bottom surface;

b) a base having a top with a periphery, a bottom load bearing surface, the top in surface engagement with the transverse bottom surface of the newel post, the load bearing surface for surface engagement with the floor such that the base transmits the load of the newel post to the floor and the base elevates the newel post above the floor to minimize deterioration of the newel post;

c) anchor means for providing a rigid anchor to the floor;

d) fastening means for securely fastening the anchor means to the base, wherein the fastening means comprises an aperture defined in the top, adapted to co-operate with and rigidly fasten to the anchor means and wherein the aperture is a threaded aperture;

e) attaching means for attaching the base to the transverse bottom surface of the newel post such that the anchor means, fastening means, and attaching means are not visible when the newel post is anchored to the floor;

f) the base further comprising a reinforcing means for reinforcing the top, the reinforcing means extending around the proximity of the periphery of the aperture; and g) wherein the reinforcing means is a cylindrical lug being integrally part of the top and extending vertically upward from the top.

2. The newel post assembly claimed in claim 1, wherein the anchor means comprises a wedge bolt with a wedge bolt bottom end adapted for anchoring the wedge bolt into a pre-drilled hole in the floor, and a threaded wedge bolt top end dimensioned and adapted to engage with the threaded aperture defined in the base, such that the base is screwed down over the threaded wedge bolt top end for bringing the load bearing surface of the base into surface engagement with the floor.

3. The newel post assembly claimed in claim 1, wherein the attaching means comprises a plurality of holes defined in the top, disposed proximate the top periphery, the holes adapted to receive fastening screws there through for bringing the newel post transverse bottom surface into surface engagement with the top of the base and rigidly fastening the newel post to the base.

4. The newel post assembly claimed in claim 1 wherein the base further comprises flanges extending vertically downward from the periphery of the top, for further elevating the top of the base above the floor.

* * * * *